United States Patent [19]

Vercillo et al.

[11] Patent Number: 4,855,573

[45] Date of Patent: Aug. 8, 1989

[54] ELECTRICALLY HEATED BINDER APPARATUS

[75] Inventors: Alfredo J. Vercillo, Harwood Heights; Nicholas M. Nanos, Morton Grove, both of Ill.

[73] Assignee: General Binding Corporation, Northbrook, Ill.

[21] Appl. No.: 171,686

[22] Filed: Mar. 22, 1988

[51] Int. Cl.[4] ..... H05B 1/02

[52] U.S. Cl. ..... 219/492; 219/518; 219/524; 219/541; 219/494; 412/33; 412/900; 156/583.9; 156/272.2

[58] Field of Search ..... 219/491, 492, 493, 494, 219/418, 518, 524, 541, 543, 507–509; 412/33, 35, 900, 902; 156/567, 908, 578, 583.9, 272.2

[56] References Cited

U.S. PATENT DOCUMENTS

| | | | |
|---|---|---|---|
| 4,077,078 | 3/1978 | Snellman et al. | 412/900 |
| 4,150,453 | 4/1979 | Vaugn | 412/900 |
| 4,266,812 | 5/1981 | Staats | 412/900 |
| 4,385,225 | 5/1983 | Qulie | 412/900 |
| 4,674,932 | 6/1987 | Lazar | 412/900 |

FOREIGN PATENT DOCUMENTS

| | | | |
|---|---|---|---|
| 8502945 | 5/1987 | Netherlands | 412/33 |

*Primary Examiner*—M. H. Paschall

*Attorney, Agent, or Firm*—Hill, Van Santen, Steadman & Simpson

[57] ABSTRACT

A heating apparatus for use in binding, which apparatus includes a base and a cover member hingedly connected to each other. The cover member includes a binding-receiving compartment positioned above a portion of the base. A pair of spaced electrical contacts are positioned in the base below the binder-receiving compartment for receiving and connecting to the binder-receiving contact. The base includes an electric circuit compartment for housing an electric circuit adapted to apply a current to said conductors upon contact with the book for a predetermined length of time.

10 Claims, 3 Drawing Sheets

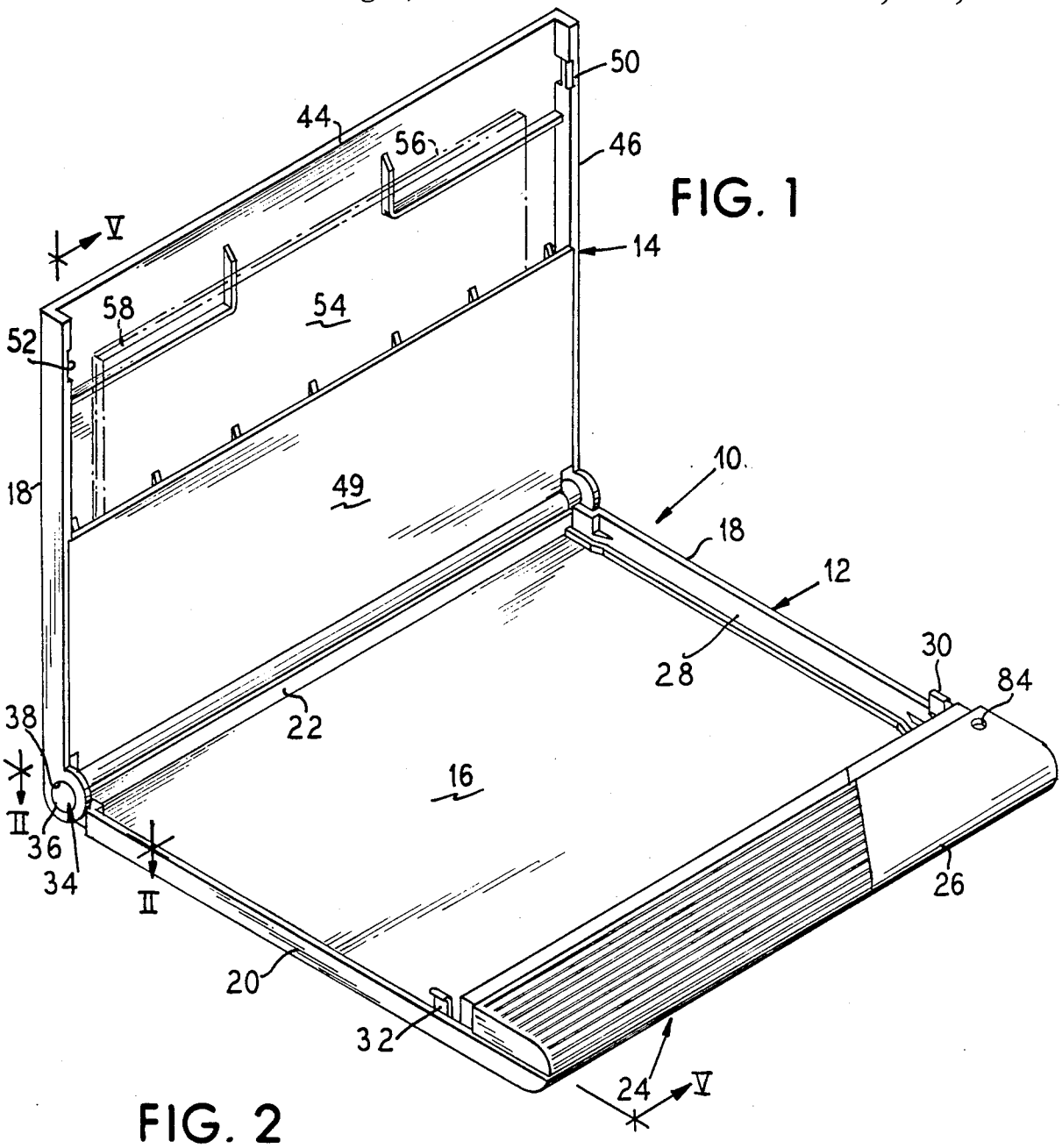
FIG. 1
FIG. 2
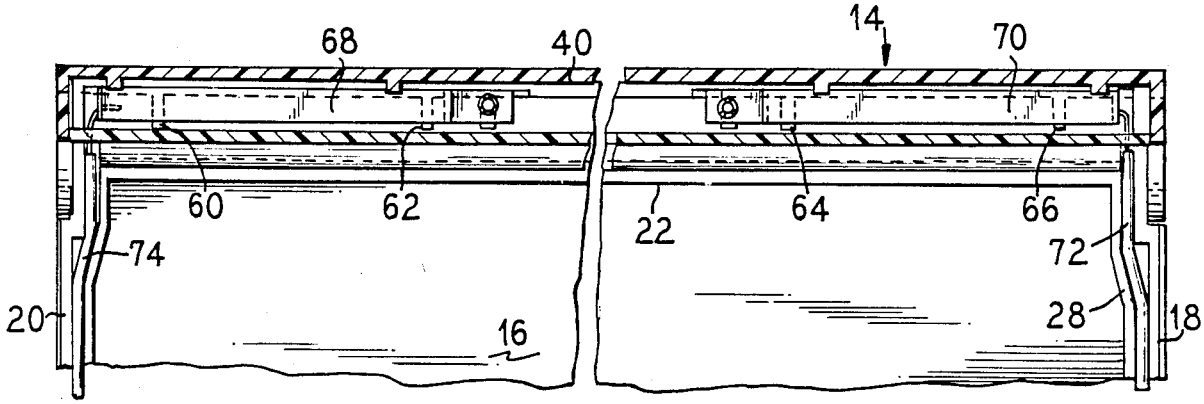

14
12
50
54
44
49
30
100
102
104
106
108
110
112
114
116
118
120
122
124
128
130
132
134
136
138
142
144
146
148
150
152
154
156
158
160
164
166
168
170
172
174
176
180
182
186
188
190
192
26
86
76
74
68

ELECTRICALLY HEATED BINDER APPARATUS

BACKGROUND OF THE INVENTION

This invention relates to a binding apparatus, and more particularly, to a binder heating apparatus.

It is desirable in some situations to bind a stack of loose sheets of paper, such as a report, into a binder cover. In one arrangement this can be done using a ring binder. In another binding apparatus, plastic strips are applied on opposite sides of the sheets to be bound, posts extend between the plastic strips, and the posts are then heat-staked to the strips so as to trap and bind the sheets therebetween.

In another apparatus, as shown in French publication No. 2546822, Registration No. 8309098, there is a heated binder apparatus in which loose sheets are bound in a binder cover between front and back covers using a heated adhesive system along the spine thereof. In this apparatus, electrodes extend along the length of the spine and outwardly of the binder and a meltable adhesive is applied to the electrodes. When a current is applied to the electrodes, heat is generated to cause the adhesive to flow. A disadvantage to that system relates to the fact that the electrodes extend beyond the cover to engage the exposed contacts for activating the electrodes and the adhesive.

The apparatus as shown in the French patent is not attractive from a commercial point of view since the user would need to use the particular apparatus as shown, clip the electrodes from the binder after binding, and the electrode connections are exposed during heating.

It is an object of this invention to provide a binder heating apparatus for heat binding sheets of paper in a binder, which apparatus is attractive, safe and easy to use.

It is a further object that the apparatus be constructed for ease of manufacture, maintenance and use.

These and other objects of this invention will become apparent from the following disclosure and appended claims.

SUMMARY OF THE INVENTION

There is disclosed herein a binder heating apparatus for use in heat binding sheets of paper into a binder cover which overcomes the problems of the prior art. The apparatus includes a base and openable cover, elements for contacting the binder, and control means for controlling and timing the electric current flowing to the binder. The apparatus as disclosed herein is attractive, compact and suitable for office use without exposure to the electrical contacts or electrical currents flowing therethrough and is safe to use.

BRIEF DESCRIPTION OF THE DRAWINGS

FIG. 1 is a perspective view of the binder heating apparatus of this invention with the top cover opened;

FIG. 2 is a sectional view along line 2—2 of FIG. 1 showing electrical contacts and hinge elements for the heating apparatus of this invention;

DESCRIPTION OF THE PREFERRED EMBODIMENT

Figure 3:
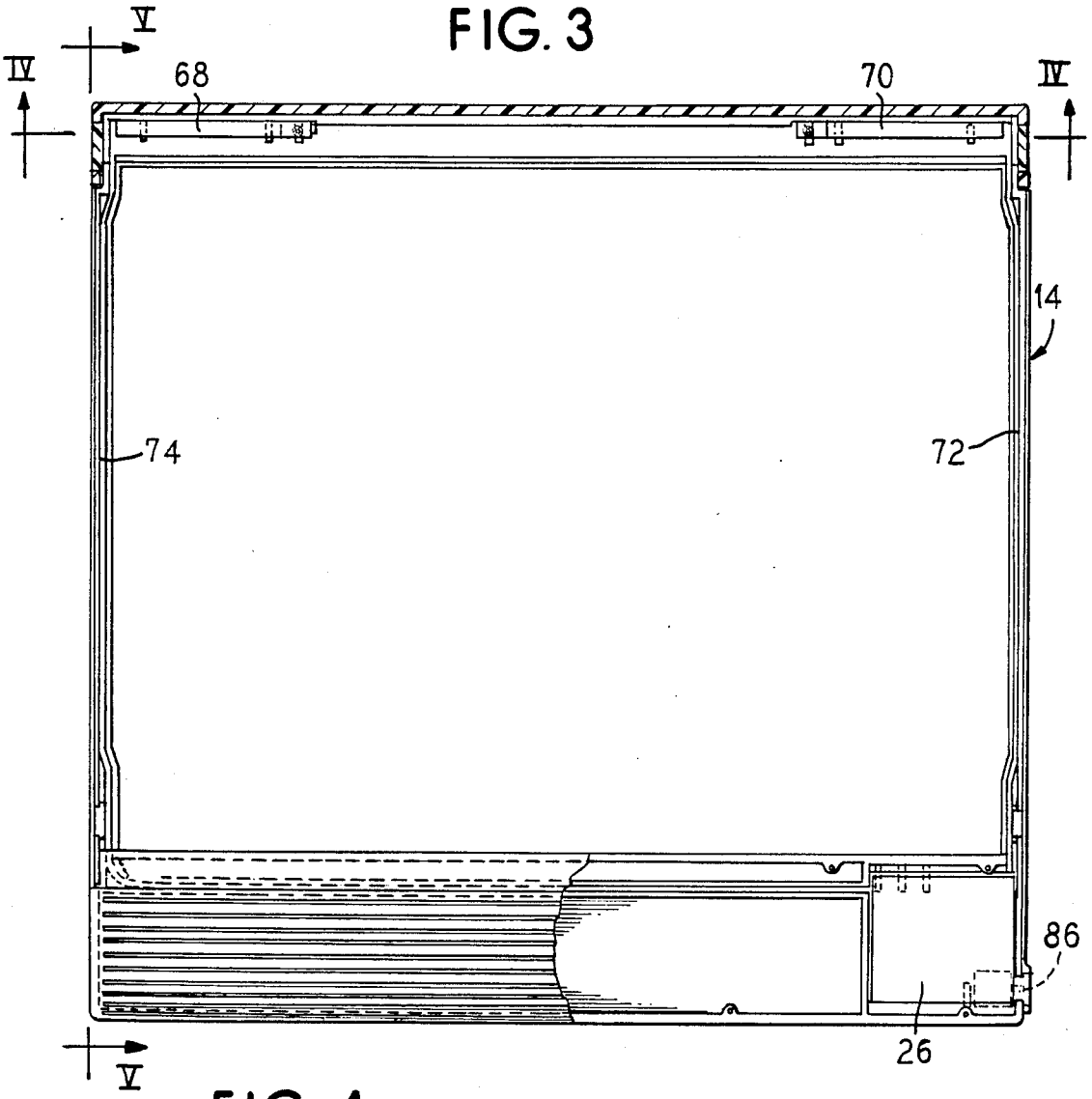
FIG. 3 is a view of the base of the heating apparatus.

Referring now to the drawings, the binder heating apparatus 10 generally includes a base 12 generally and a top or cover 14 generally, both of which are of molded plastic. The base includes a flat bottom wall 16, a pair of side walls 18 and 20, and a rear wall 22. The front 24 is shaped and includes an electronics compartment 26. Wire guides, such as 28, are molded into the base adjacent each side wall to guide wires from the electronics compartment 26 to a pair of spaced electrical contacts at the back of the heating apparatus base. A pair of latch tongues, such as 30 and 32, are molded integral with each side walls 18 and 20 adjacent the front edge.

The cover 14 is hingedly connected by a hinge construction, such as 34, to the back wall of the base. It is noted that each of the side walls 18 and 20 are recessed inwardly so as to receive the hinge mechanism. In practice, the hinge mechanism includes a hinge disc 36 molded into the back wall or back of the base 12 and a circular or annular surrounding hinge portion 38, which is molded into the cover member. It will be appreciated that these members are snap-fitted together so as to form the desired hinge.

The cover 14 defines a binder receiving compartment formed by the top wall 44, a pair of side walls 46 and 48, and the compartment wall 49. The side walls act to space the cover compartment forming wall 49 from the top wall 44 and to form the annular portion of the hinge 38. The binder compartment is open at both the top and the bottom ends so as to expose the binder cover to the electrical contacts. A pair of latch-receiving members 50 and 52 are molded adjacent the front or top of each of side walls.

Figure 4:
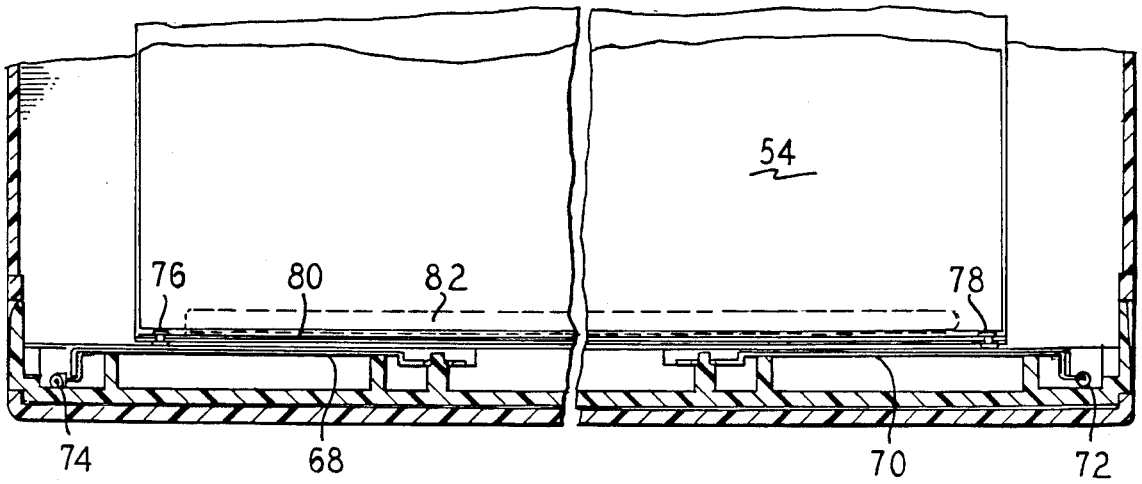
FIG. 4 is a sectional view taken along line 4—4 of FIG. 3 showing the heating elements of this invention in elevation.
Figures 5, 6, 7, 8:
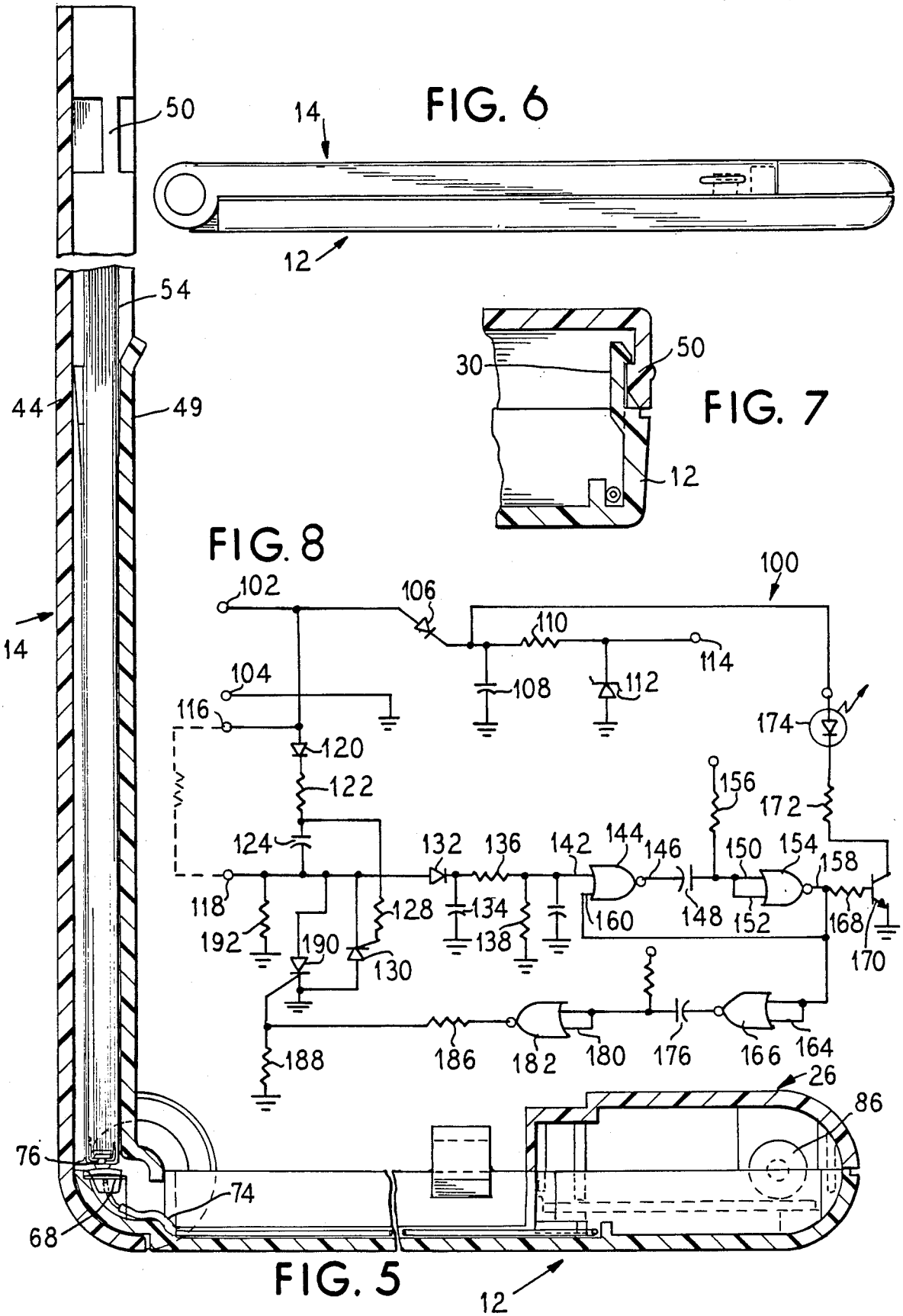
FIG. 5 is a vertical sectional view taken along line 5—5 of FIG. 1 showing the heating apparatus.
FIG. 6 is a side elevational view showing the apparatus in the closed position.
FIG. 7 is a vertical sectional view taken along lines 7—7 of FIG. 6 and showing the latching and locking mechanism of FIG. 6.
FIG. 8 is a schematic diagram showing the electronic controls for this apparatus.

A booklet 54, which is to be bound, is shown positioned within the compartment and extends downwardly toward electrical contacts to be discussed herein. The booklet generally includes a cover member 56 that has a front cover, a back cover and a spine, and a plurality of loose sheets of paper 58, which are to be bound into the cover. The binder spine or back (as seen in FIGS. 4 and 5) includes a layer of heat-activated adhesive, which heat is generated by an electrical resistance member or conductive layer. A pair of spaced contacts or rivets provide for the electrical connection between the binder and heating apparatus.

The base includes integrally molded upstanding electrical contact supporting ribs, such as 60 and 62, which are molded integral with the base bottom wall 16. A second set of ribs 64 and 66 are molded integral with the base also and are spaced apart from the first set 60 and 62 so as to space the contacts apart. The electrical contacts 68 and 70 are metal strips which are supported on the rib sets and are soldered to wires, such as 72 and 74, which extend through the wire guides and connect to the respective conductors or contacts. It will be appreciated that since the compartment is open at the bottom, the booklet engages the contacts 68 and 70 so as to make electrical connection therebetween, as seen in FIGS. 4 and 5.

Referring now to FIG. 3, the base is shown and it is seen that the contacts 68 and 70 are spaced from one another and that the wires 72 and 74 connecting the contacts to the electronics compartment are held in position in the base 12 by molded guide rails. The wire 74 extends from the guide through the front compartment to the electronics compartment 26.

FIG. 4 shows the manner in which the binder 54 engages the contacts 68 and 70. As can be seen, the binder extends downwardly and the spaced and electrically conductive rivets 76 and 78, which extend through the spine of the binder, and electrically contact the conductors or contacts 68 and 70. A conducting strip such as 80, made of a conducting film or layer, extends between the rivets 76 and 78. An adhesive 82 is applied to the conductor strip and the adhesive is activated by heat generated by the electric current flowing through the conductor strip 80 to bind loose pages to the binder 54. In other words, the binder acts to complete the circuit between contacts 68 and 70. The circuit is completed by contact between rivet 76 and contact 68, the conductive layer 80 and the rivet 78 and contact 70.

In operation, the electrical current is applied for a specified length of time which has been predetermined to melt the adhesive and activate the adhesive so as to bind the sheets of paper to the binder. A cooling period is defined thereafter. As can be seen, the entire heating operation and all electrical contact is within the enclosure of the base and cover and within the binder so as to maximize safety.

FIG. 5 is another view showing the base 12, the cover 14 and the book 54 in position in the book-receiving compartment defined by the top wall 44 and compartment wall 49. Again, it is seen that the booklet rivets, such as 76, contact the electrical connector 68 so as to provide for electrical flow and the conductor 74 is also shown.

The latch 30, best seen in FIG. 1, is a resilient cantilevered-type member for cooperation with the latch-receiving recess 50. The latch-receiving apparatus is further shown in FIGS. 6 and 7. In those views, the cover 14 is shown in a closed position on the base 12 with the latch mechanisms operative so as to lock the heating apparatus closed for movement between various places. The latch system is shown in detail in FIG. 7, and it is seen that the latch includes the cantilevered latching member or tongue 30, which is integrally molded with the side wall 20 of the base. The latch-receiving member 50 also includes a tongue-receiving recess for cooperation with the latch 30 so as to lock the top and bottom together.

The electronics compartment 26 includes a timing system for applying an electric current of a predetermined value for a predetermined length of time to the electrical contacts. Once the circuit is closed, the binder contacts the electrical contacts 68 and 70. An indicator light 84 indicates when the circuit is operating and is on for the length of time in which there is electrical energy passing through the contacts and during the cooling period. Power is applied to the electronics compartment through the plug or connector 86.

In FIG. 8, the control circuit 100 is shown for use in the binder heating apparatus of the present invention. The control circuit 100 includes a pair of AC input leads 102 and 104 for connection to outside AC power. The input power lead 104 is connected directly to circuit ground, while the power input lead 102 is connected through a rectifier or diode 106 to a filter formed by a capacitor 108 and resistor 110 and then connected across a zener diode 112, that is in one embodiment rated at 6.2 volts. This provides DC power Vcc at circuit power lead 114.

Also connected to the positive power input 102 is a positive load or output lead 116. The output lead 116 along with a second output lead 118 is selectively connected across the rivet contacts of the book to be bound.

Across the output or load leads 116 and 118 are connected a diode 120, a resistor 122 and a capacitor 124. A filtered signal is connected from between the resistor 122 and the capacitor 124 through resistor 128 to a gate input of a silicon controlled rectifier (SCR) 130 which turns on at every negative half cycle of the AC line power.

A timing circuit connected to the load lead 118 includes a diode 132, a capacitor 134 connected to ground, resistors 136 and 138 through which the capacitor 134 selectively discharges, and a further capacitor 140 connected between ground and a first input 142 of a NOR logic gate 144. An output 146 of the NOR gate 144 is connected through a capacitor 148 to both inputs 150 and 152 of a second NOR gate 154, which is connected as an inverter or single shot. The inputs 150 and 152 of the NOR gate 154 are also connected through a resistor 156 to circuit power Vcc. An output 158 of the NOR gate 154 is linked through a feedback loop to the second input 160 of the first NOR gate 144. The output 158 is also connected to both inputs 162 and 164 of a third NOR gate 166, also an inverter or single shot, as well as through a resistor 168 to the base of a transistor 170. The transistor 170 has its collector connected through a resistor 172 and an indicator LED 174 to rectified line power at the cathode of the diode 106.

The third NOR gate 166 is linked through a capacitor 176 to both inputs 178 and 180 of a fourth NOR gate 182, that is connected as a single shot or inverter. Just as with the NOR gate 154, the NOR gate 182 also has the inputs 178 and 180 connected through a resistor 184 to circuit power Vcc. The output of the NOR gate 182 is connected through voltage dividers resistors 186 and 188 to ground. Between the resistors 186 and 188 is connected the gate input of a second silicon controlled rectifier (SCR) 190. The SCR 130 is a slave to the SCR 190 so that when both are on, they alternately conduct to connect output 118 to ground. A resistor 192 is connected between the load output 118 and ground.

The circuit 100 operates as follows: The steady state condition with no load applied across the load outputs 116 and 118 finds the capacitor 134 discharged, thereby holding the input 142 of the first NOR gate 144 low. The output 146 of this gate is at a high state which results in a low signal at the output 158 of the NOR gate 154. The low at the output 158 causes the output of the third NOR gate 166 to be at a high state and the output of the fourth NOR gate 182 to be a low state. This keeps the SCR 190 turned off.

When a load, such as a binder with a heating element, is applied across the load leads 116 and 118, the capacitor 134 charges up immediately to set the input 142 of the logic gate 144 high. This switches the output 146 of the first NOR gate 144 low so that the second NOR gate 154 switches its output at 158 high. The high signal at output 158 turns on the transistor 170 so that current is conducted through the indicating LED 174. The high signal at 158 also switches the output of NOR gate 166 low resulting in the output of NOR gate 182 going high to turn on the gate of the SCR 190. The SCRs 130 and 190 are connected as a bi-lateral switch so that full power is applied across the load outputs 116 and 118.

The capacitor 134 begins to slowly discharge through the resistors 136 and 138 until the input 142 again goes low. However, since the output 158 is now high, the input 160 is held at a high level by the feedback loop so that no change occurs at the output 146 of the NOR gate 144.

Timing of the heating cycle occurs during a first time period set by the RC combination 184 and 176. In particular, once the output of the third NOR gate 166 goes low, the capacitor 176 charges through the resistor 184 until the input level at the inputs 178 and 180 of the NOR gate 182 are reached, which causes a change in state of the output signal from the NOR gate 182 back to a low state. In a preferred embodiment, this occurs approximately forty-five seconds after power is initially applied to the load.

A cool down period is provided by the RC combination of resistor 156 and capacitor 148. The capacitor 148 charges through the resistor 156 for a second time period or timing cycle, which in a preferred embodiment is sixty seconds, after which the NOR gate 154 changes state to turn off the transistor 170 and the indicator light 174. Now that the indicator light 174 is off, indicating to a user of the present apparatus that the bound book can be removed. During removal of the book, the capacitor 134 serves to debounce the load output so that the circuit is not accidentally turned on again.

Thus, upon insertion of a load across the load leads, power is applied for forty-five seconds, in the preferred embodiment, followed by a fifteen seconds cool down period after which the indicator light 174 is turned off.

Although the invention has been described with respect to preferred embodiments, it is not to be so limited as changes and modifications can be made which are within the full intended scope of the invention as defined by the appended claims.

I claim as my invention:

1. An apparatus for binding loose papers in a binder cover having an electrically conductive layer and a heat-activated adhesive means along the spine thereof, spaced electrical contacts along the length of the spine and contacting a conductive layer, said apparatus comprising:

a base member, an interconnected cover member, a pair of spaced electrical contact means, which are spaced from each other a distance less than the length of the spine, for electrical connection with the electrical contacts associated with a binder cover, said apparatus contacts associated with one of said base or cover members, and binder-receiving means associated with the other of said cover member and base member for positioning binder contacts in electrical connection with the spaced electrical contact means of said apparatus within the length of the spine; and an electronic timing circuit means operatively associated with one of said base member or cover member for delivering electric current to said spaced electrical contacts of said apparatus upon closure of the circuit means.

2. An apparatus as in claim 1, wherein said base member and said cover member are hingedly connected to one another.

3. An apparatus as in claim 2, wherein said base includes a front and a back and said spaced electrical contacts are mounted to said base adjacent said back, and electrical compartment means are contained at the front of said base and interconnected with said electrical contact means.

4. An apparatus as in claim 1, wherein said cover member includes means defining a binder-receiving compartment formed of said cover member and a compartment-defining wall for receiving said binder therebetween and positioning said binder in said compartment and for electrical contact with said apparatus conducting means.

5. An apparatus as in claim 1, wherein one of said base member and cover member further includes a pair of resilient cantilevered latch tongue means and the other of said base member and said cover member includes a pair of latch-receiving recesses for cooperation with said tongue for closing said cover on said base.

6. An apparatus as in claim 1, wherein said base member includes wire guide means for use in guiding an electrical conductor between said electronics compartment and each of said electrical contacts, said guide means being adjacent each side wall of the base.

7. An apparatus as in claim 1, wherein there is provided a pair of upstanding contact supporting ribs molded integrally with said base, and said electrical contact means includes a pair of metal strips, each adapted to be supported on said base and for connection with each of said conductors.

8. An apparatus as in claim 1, wherein said electronic timing circuit means includes means for delivering an electric current to said electrical contacts for a predetermined length of time.

9. An apparatus as in claim 8, wherein said electronic timing circuit means also includes indicator light means, which means are operative during activation of said timing circuit means and for a predetermined cooling period thereafter.

10. An apparatus as in claim 1, wherein the binder electrical contacts comprise a pair of rivet-like members, each of which extend through a binder spine and contact an electrically conductive layer and said apparatus electrical contact means are spaced apart a distance effective to contact the binder contacts which extend through the spine a binder cover.

* * * * *